US008636284B2

(12) United States Patent
Nakayama

(10) Patent No.: US 8,636,284 B2
(45) Date of Patent: Jan. 28, 2014

(54) SHEET CONVEYER

(71) Applicant: Daisuke Nakayama, Nagoya (JP)

(72) Inventor: Daisuke Nakayama, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/630,241

(22) Filed: Sep. 28, 2012

(65) Prior Publication Data

US 2013/0134655 A1 May 30, 2013

(30) Foreign Application Priority Data

Nov. 30, 2011 (JP) ..... 2011-261470

(51) Int. Cl.
*B65H 7/02* (2006.01)

(52) U.S. Cl.
USPC ..... 271/265.04; 271/110; 271/263

(58) Field of Classification Search
USPC ..... 271/262, 263, 265.04, 110, 111
See application file for complete search history.

(56) References Cited

U.S. PATENT DOCUMENTS

| | | | | |
|---|---|---|---|---|
| 5,139,339 | A * | 8/1992 | Courtney et al. | 356/446 |
| 6,481,705 | B1 * | 11/2002 | Okada | 271/4.03 |
| 7,172,195 | B2 * | 2/2007 | Sano et al. | 271/262 |
| 7,654,522 | B2 * | 2/2010 | Tonami | 271/262 |
| 7,819,400 | B2 * | 10/2010 | Miyoshii et al. | 271/265.04 |
| 7,905,484 | B2 * | 3/2011 | Komuro | 271/263 |
| 8,047,541 | B2 * | 11/2011 | Segawa | 271/265.04 |
| 2004/0007806 | A1 * | 1/2004 | Suzuki | 271/110 |
| 2007/0222140 | A1 * | 9/2007 | Tsuchida | 271/171 |
| 2011/0127712 | A1 * | 6/2011 | Komuro | 271/110 |
| 2011/0317230 | A1 * | 12/2011 | Tanaka | 358/498 |

FOREIGN PATENT DOCUMENTS

| | | |
|---|---|---|
| JP | 2000-159393 | 6/2000 |
| JP | 2002-179289 | 6/2002 |
| JP | 2005-082350 | 3/2005 |
| JP | 2006-248701 | 9/2006 |

* cited by examiner

*Primary Examiner* — Jeremy R Severson
(74) *Attorney, Agent, or Firm* — Banner & Witcoff, Ltd.

(57) ABSTRACT

A sheet conveyer, including a first roller to rotate to convey a sheet in a conveying direction; a separator arranged to be opposed to the first roller and configured to nip the sheet and to separate the sheet from other sheets; a multiple sheet sensor arranged in a downstream position with respect to the first roller and configured to sense presence of multiple sheets, the multiple sheet sensor including an emitter and a receiver; and a second roller arranged in a downstream position with respect to the multiple sheet sensor and configured to convey the separated sheet, is provided. A component being at least one of the emitter and the receiver is arranged in an outer side position with respect to the separator, and at least a part of the component is arranged in an inner side position with respect to the second roller.

8 Claims, 8 Drawing Sheets

SHEET CONVEYER

CROSS REFERENCE TO RELATED APPLICATION

This application claims priority from Japanese Patent Application No. 2011-261470, filed on Nov. 30, 2011, the entire subject matter of which is incorporated herein by reference.

BACKGROUND

1. Technical Field

An aspect of the disclosure relates to sheet conveyers.

2. Related Art

A sheet conveyer conveys a sheet in a sheet conveyer path. The sheet conveyer may include a first roller, a separator arranged to be opposed to the first roller, and a multiple sheet sensor arranged in a downstream position with respect to the first roller along a sheet conveying direction. The multiple sheet sensor includes an emitter and a receiver.

In the sheet conveyer, the first roller feeds the sheet in the sheet conveying direction whilst rotating with the sheet being in contact with the first roller. In this regard, the separator nips the sheet in cooperation with the first roller and may separate the sheet from other sheets in a stack. The multiple sheet sensor thereafter detects presence of multiple sheets, that is, whether the sheet being conveyed by the first roller is correctly separated and fed one-by-one in the sheet conveyer path.

SUMMARY

In the sheet conveyer, whilst the sheets of paper are conveyed serially in the sheet conveyer path, paper dust may be produced by friction, which can be caused between the sheets and between the sheet and the separator. The dust may float and travel within the sheet conveyer along with the sheet in the sheet conveying direction toward a downstream of the flow of the sheet beyond the first roller. The dust may then adhere to the emitter and the receiver in the multiple sheet sensor and affect accuracy of the multiple sheet sensor undesirably. In other words, the dust may lower the accuracy of the multiple sheet sensor.

An aspect of the present disclosure may be advantageous in that sheet conveyers, in which the accuracy of detecting the presence of multiple sheets is prevented from being lowered, are provided.

According to an aspect of the disclosure, a sheet conveyer configured to convey a sheet in a conveyer path may include a first roller, a separator, a multiple sheet sensor, and a second roller. The first roller may be configured to contact the sheet and rotate to convey the sheet in a conveying direction. The separator may be arranged to be opposed to the first roller and configured to nip the sheet in cooperation with the first roller and to separate the sheet from other sheets. The multiple sheet sensor may be arranged in a downstream position in the conveying direction with respect to the first roller and configured to sense presence of multiple sheets. The multiple sheet sensor may include an emitter and a receiver. The second roller may be arranged in a downstream position in the conveying direction with respect to the multiple sheet sensor and configured to convey the separated sheet. A component being at least one of the emitter and the receiver may be arranged in an outer side position with respect to the separator along a widthwise direction, which is orthogonal to the conveying direction. At least a part of the component may be arranged in an inner side position with respect to the second roller along the widthwise direction.

BRIEF DESCRIPTION OF THE ACCOMPANYING DRAWINGS

FIG. 1 is a perspective view of an image reading apparatus 1 showing a front face.

FIG. 2 is a perspective view of the image reading apparatus 1 showing the front face with a feeder tray 50 and an upper cover 93 being open.

FIG. 3 is a perspective view of the image reading apparatus 1 showing a rear face with the feeder tray 50, the upper cover 93, and a discharge tray 6 being open.

Figure 6:
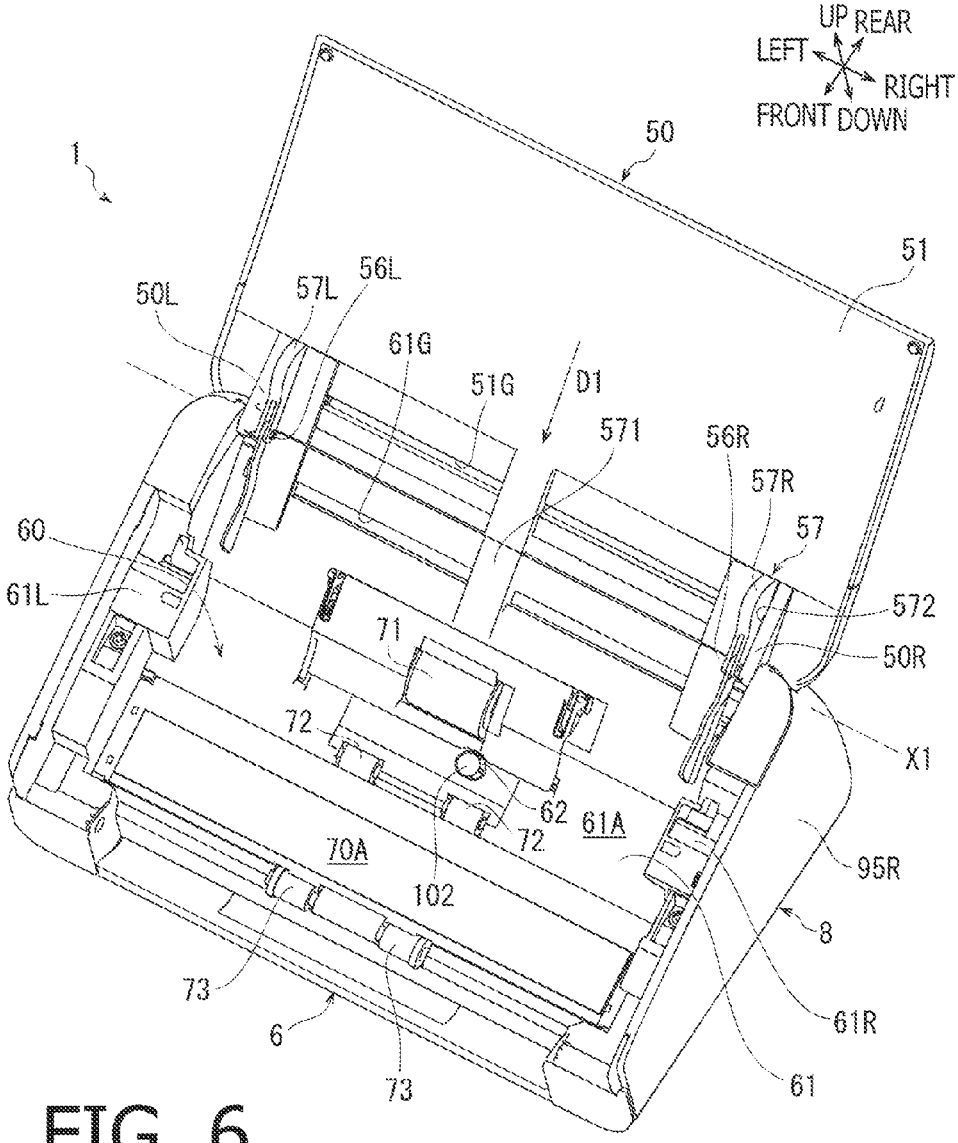

FIG. 6 is a perspective upper-side view of the image reading apparatus 1 with the feeder tray 50 being open and the upper cover 93 being removed.

Figure 7:
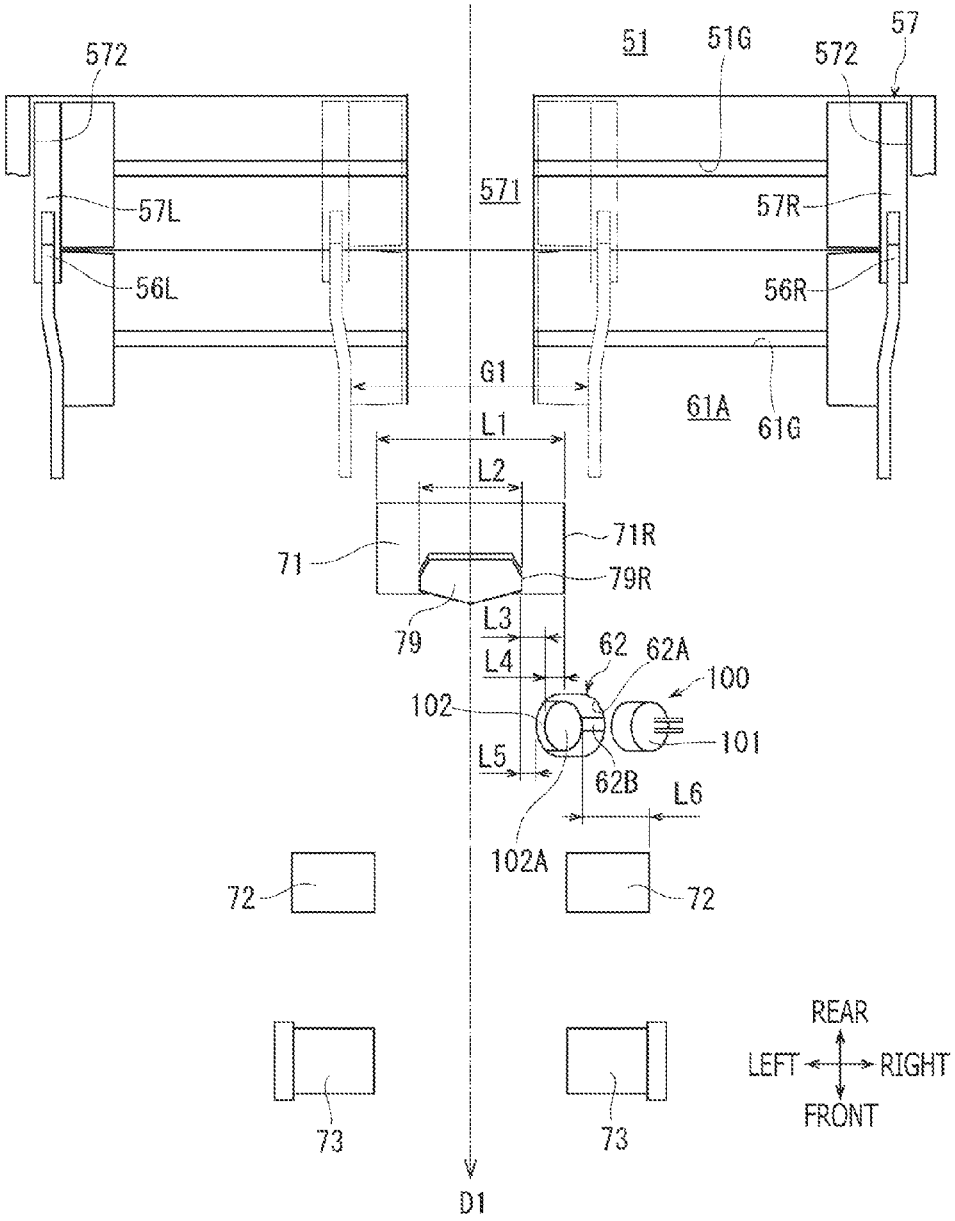

FIG. 7 is a diagram to illustrate positional relation amongst a width-position guide 57, a feed roller 71, a multiple sheet sensor 100, and conveyer rollers 72 in the image reading apparatus 1.

Figure 5:
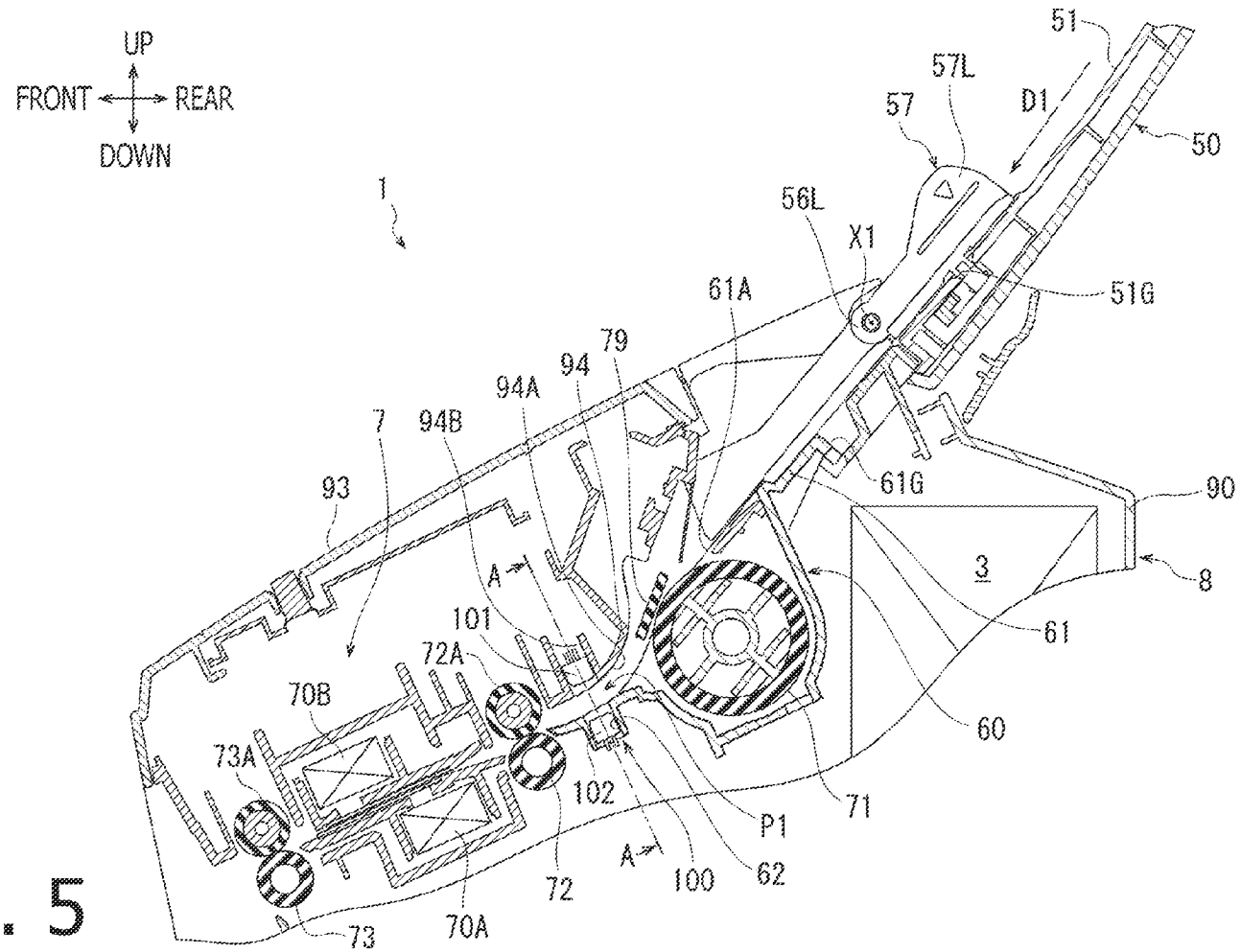
FIG. 5 is a partially enlarged cross-sectional side view of the image reading apparatus 1.
Figure 8:
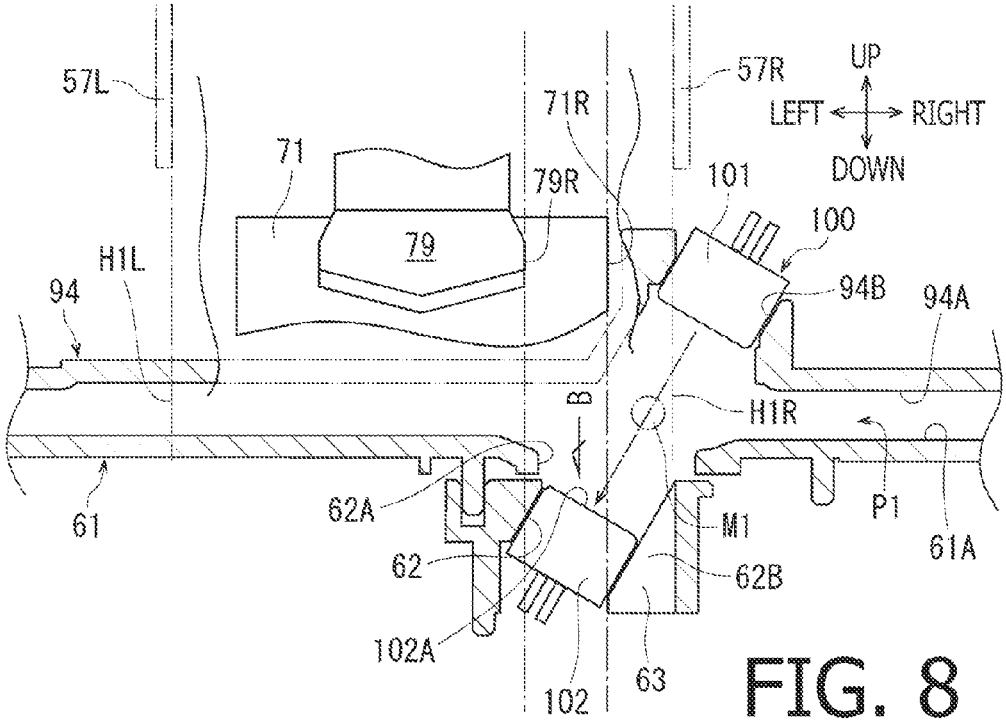

FIG. 8 is a partially enlarged cross-sectional view of the image reading apparatus 1 taken along a line A-A shown in FIG. 5.

Figure 9:
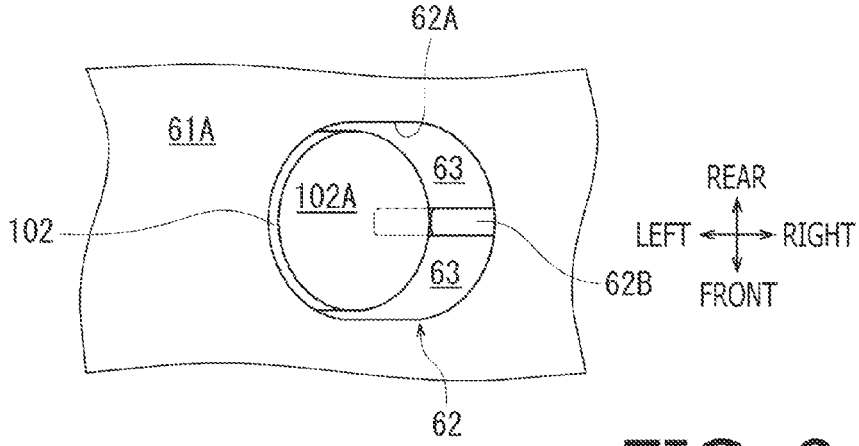

FIG. 9 is a partially enlarged view of a receiver 102 and a sensor housing hole 62 for the multiple sheet sensor 100 of the image reading apparatus 1 taken along a direction indicated by an arrow B in FIG. 8.

Figure 10:
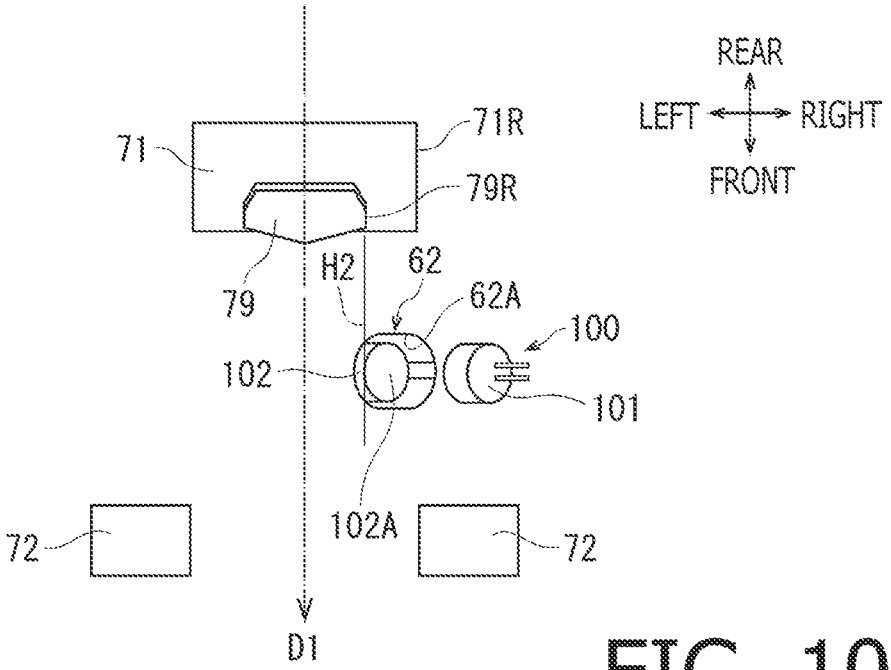

FIG. 10 is a diagram to illustrate another example of the image reading apparatus 1.

Figure 11:
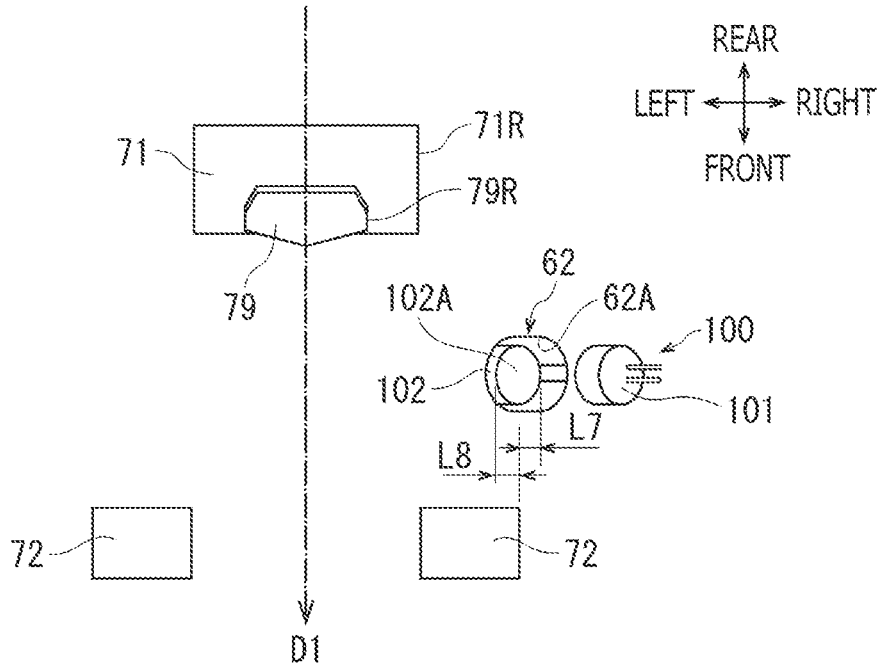

FIG. 11 is a diagram to illustrate still another example of the image reading apparatus 1.

DETAILED DESCRIPTION

Hereinafter, an image reading apparatus 1 as an example embodiment of a sheet conveyer according to the disclosure will be described with reference to the accompanying drawings.

In the example embodiment described below, directions concerning the image reading apparatus 1 will be referred to based on orientations indicated by arrows shown in each drawing. For example, a viewer's lower-left side appearing in FIG. 1, on which a discharge tray 6 is arranged, is referred to as a front face of the image reading apparatus 1. An upper-right side in FIG. 1, opposite from the front, is referred to as rear. A side, which corresponds to the viewer's upper-left side is referred to as a left-side face, and an opposite side from the left, which corresponds to the viewer's lower-right side, is referred to as a right-side face. The right-left direction of the image reading apparatus 1 may also be referred to as a cross-wise or lateral direction. The up-down direction in FIG. 1 corresponds to a vertical direction of the image reading apparatus 1.

Detailed Configuration of the Image Reading Apparatus 1

Figure 2:
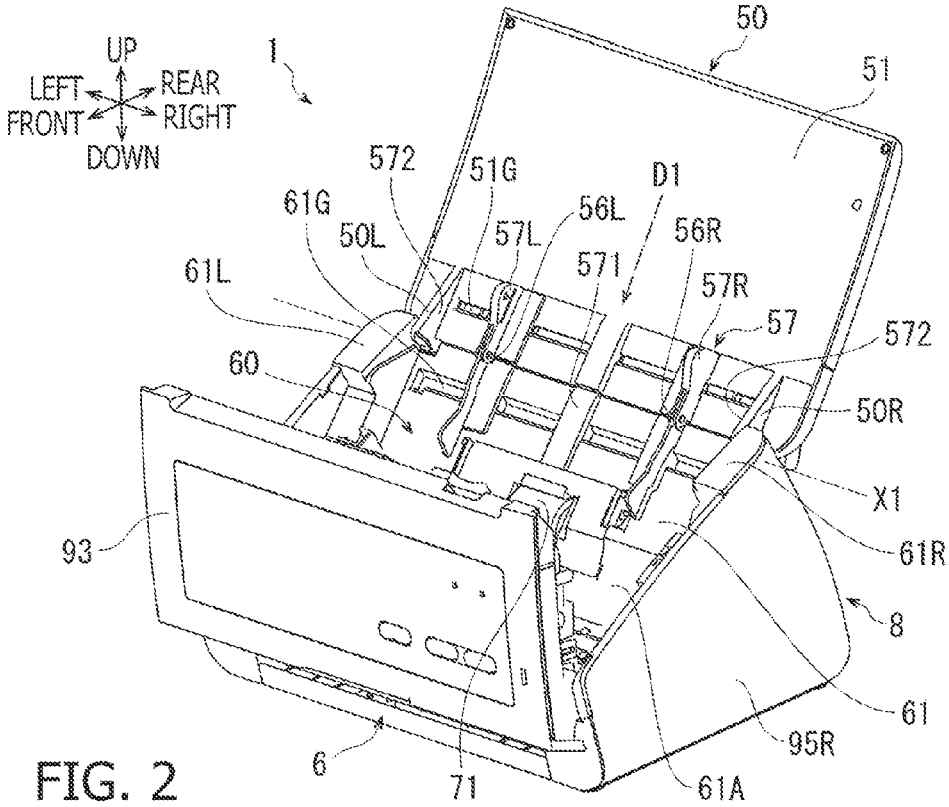
Figure 3:
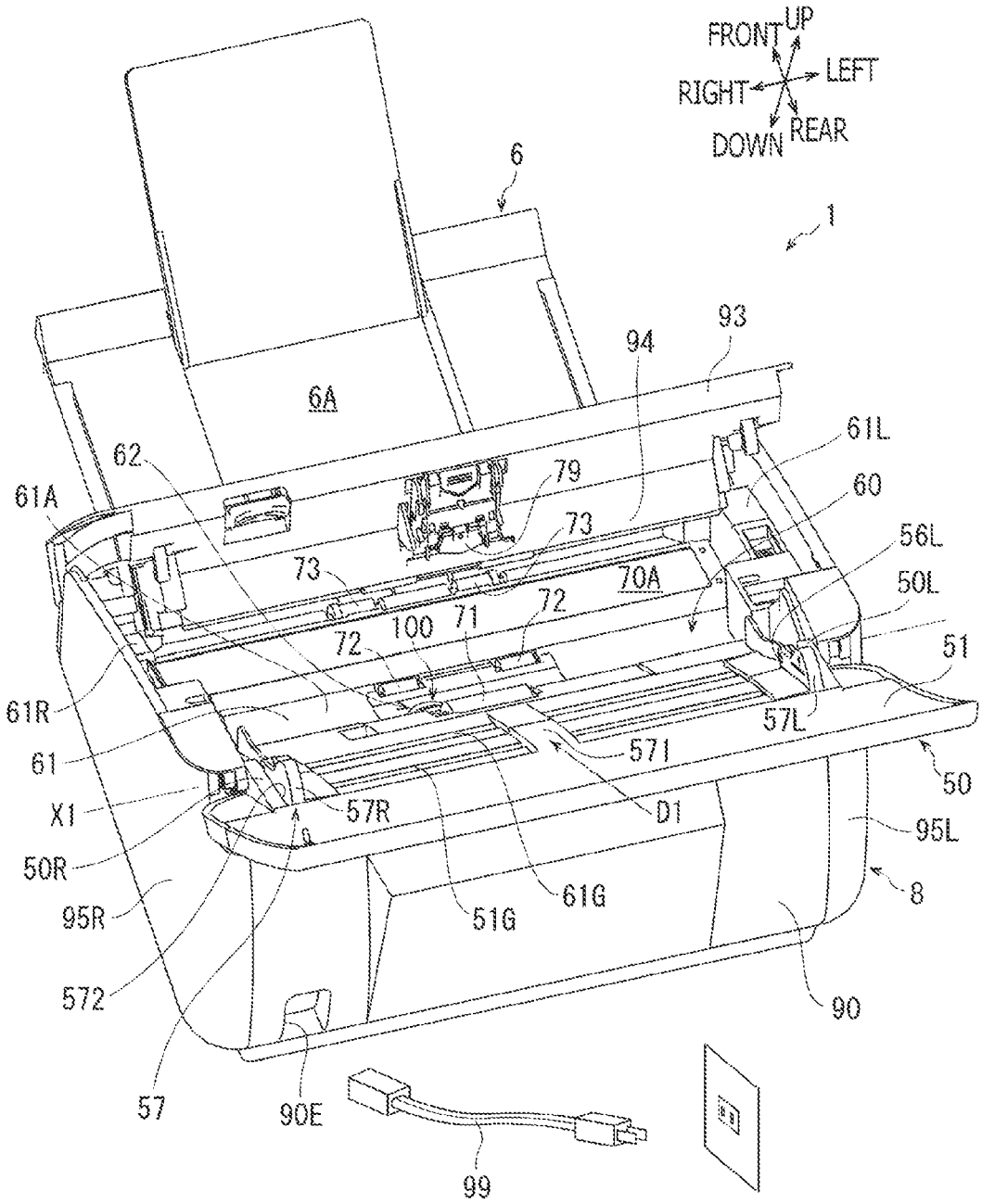
Figure 4:
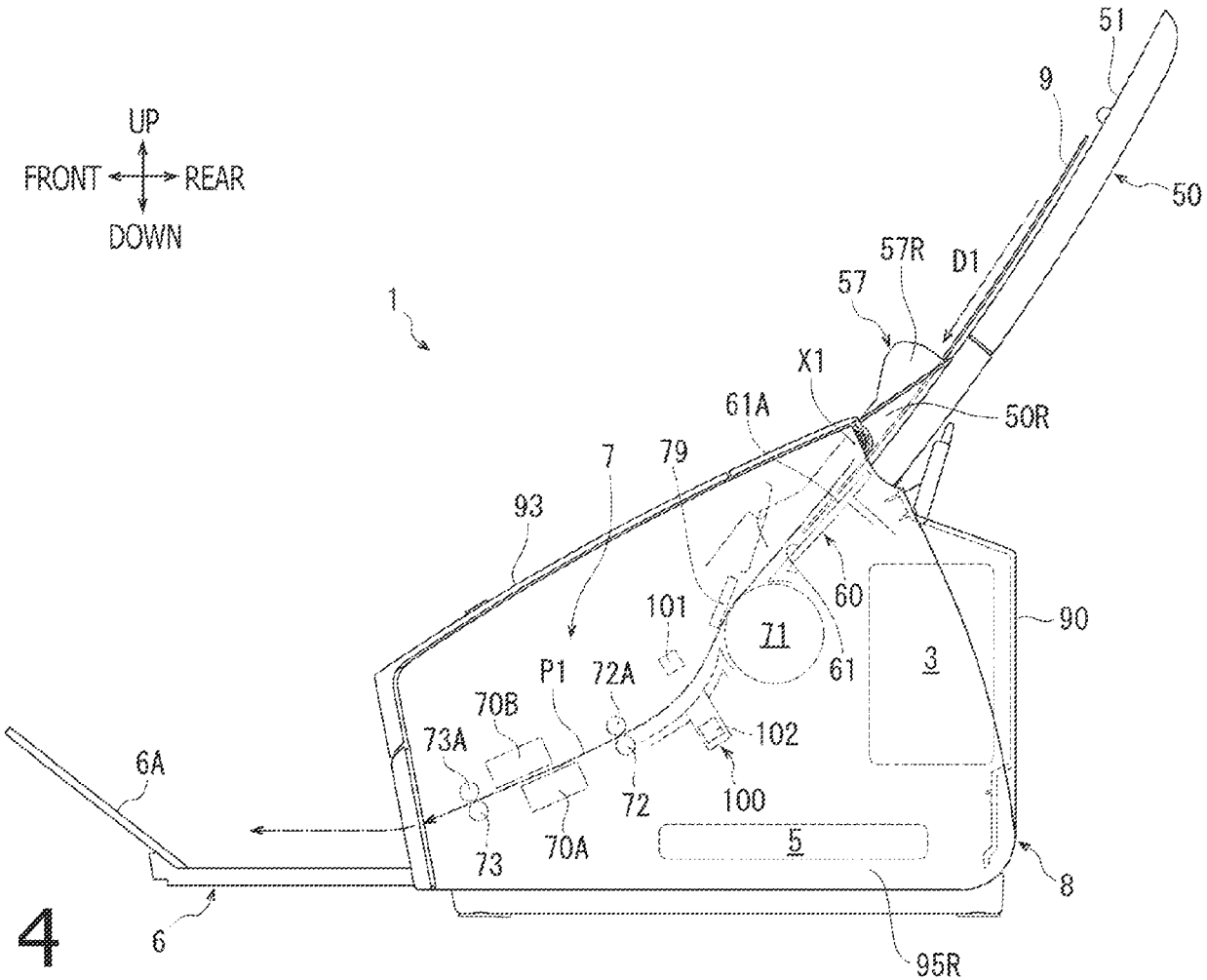
FIG. 4 is a side view of the image reading apparatus 1.

As shown in FIGS. 1-4, the image reading apparatus 1 includes a chassis 8, a feeder tray 50, and a discharge tray 6. Further, as shown in FIG. 4, a conveyer path P1, in which a sheet 9 is conveyed from the feeder tray 50 to the discharge tray 6, is formed in the image reading apparatus 1.

The chassis 8 constitutes a box-shaped main body of the image reading apparatus 1 and includes an upper cover 93 forming an upper face of the chassis 8, a rear cover 90 forming a rear face of the chassis 8, and lateral covers 95R, 95L, forming lateral (right and left) faces of the chassis 8. The chassis 8 further includes internal frames covered by the upper cover 93, the rear cover 90, and the lateral covers 95R, 95L. The internal frames include a lower chute 60 (see FIGS. 3 and 5) and additional frames (not shown), which are assembled together.

As shown in FIG. 5, the upper cover 93 is formed in a shape of a plane panel, which is arranged to incline upward from the front face toward the rear face of the chassis 8 over the lower chute 60. The upper cover 93 includes an upper guide 94, which faces the lower chute 60 from above. A lower side of the upper guide 94 provides an upper guide plane 94A being a top plane of the conveyer path P1. As shown in FIGS. 2 and 3, the upper cover 93 is swingable to uplift a rear end thereof upward and separated from the lower chute 60. Thus, when, for example, a user needs to handle a sheet jam or other maintenance operations, the user can access a lower guide 61 being a bottom of the lower chute 60, a feed roller 71, or conveyer rollers 72 by uplifting the upper cover 93.

The feeder tray 50 is formed in a thin plate, one side of which is configured to serve as a placement surface 51. On right-side and left-side corners of the feeder tray 50, hinges 50R, SOL are integrally formed. The feeder tray 50 is swingably supported by the chassis 8 to swing about a swing axis S1, which extends in a crosswise direction at an upper rear position in the chassis 8, via the hinges 50R, 50L.

Figure 1:
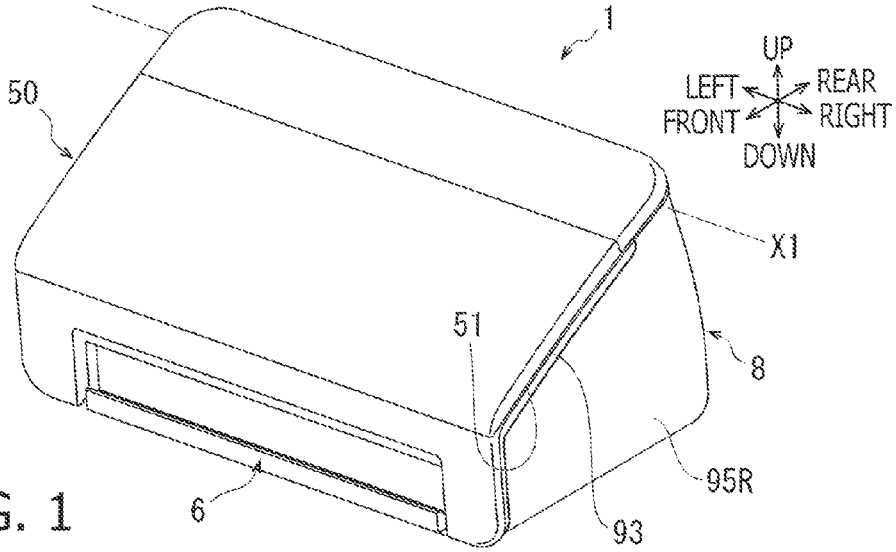

As shown in FIG. 1, when in a closed posture, the feeder tray 50 is placed over the upper cover 93 with the placement surface 51 facing downward. The position of the feeder tray 50 in the closed posture shown in FIG. 1 will be referred to as "housed position."

When being rotated about the swing axis X1, as shown in FIGS. 2-6, the feeder tray 50 is moved to a rearward position with respect to the chassis 8 and into an open posture, in which the placement surface 51 faces upward. The position of the feeder tray 50 in the open posture as shown in FIG. 2 will be referred to as "usable position."

When the feeder tray 50 is in the usable position, the sheet 9 can be placed on the placement surface 51 and can be conveyed from the placement surface 51 frontward along a conveying direction D1 toward the discharge tray 6 (see FIG. 4).

In this regard, the direction of width of the sheet 9 ("sheet-width") being conveyed in the conveying direction D1 coincides with the crosswise (lateral) direction of the image reading apparatus 1. Further, an "inner side" in the sheet-width refers to a side closer to a widthwise center of the sheet 9 being conveyed. Meanwhile, an "outer side" along the direction of sheet-width refers to a side farther from the widthwise center of the sheet 9 being conveyed.

As shown in FIG. 6, the lower chute 60 includes a lower guide 61, which is formed in a shape of a flat panel, and lateral walls 60R, 60L, which have the lower guide 61 interposed in a midst position there-between. The lower guide 61 spreads in parallel with the crosswise direction and extends in an angled posture to decline from a position in the vicinity of the swing axis X1 on the rear side toward the discharge tray 6 on the front side. As shown in FIG. 5, an upper surface of the lower guide 61 faces the upper guide plane 94A of the upper cover 93 from a lower position across the conveyer path P1. An upper plane of the lower guide 61 support a lower side of the sheet 9 being conveyed from below and serves as a bottom plane 61A of the conveyer path P1. As shown in FIG. 6, when the feeder tray 50 is in the usable position, the bottom plane 61A provides an inclined surface in continuity with the placement surface 51.

As shown in FIG. 6, the image reading apparatus 1 further includes a width-position guide 57, which serve to place the sheet 9 in a correct crosswise position on the placement surface 51. The width-position guide 57 includes a pair of rib-shaped guide pieces 57R, 57L, which are arranged in line-symmetrical crosswise (right and left) positions with each other. The guide pieces 57R, 57L extend in parallel with the conveying direction D1 from an upper end of the placement surface 51 to the bottom plane 61A. Each of the guide pieces 57R, 57L is formed to have a joint 56R, 56L in a longitudinally (along the conveying direction D1) midst position. The joints 56R, 56L allow the guide pieces 57R, 57L to be folded or to align straight by rotating about the swing axis X1 when the feeder tray 50 is moved from the housed position to the usable position, and vice versa.

On the placement surface 51 and the bottom plane 61A, guide rails 51G, 61G being narrow grooves extending in the crosswise direction are formed. The guide pieces 57R, 57L are engaged with the guide rails 51G, 61G and slidable in the crosswise direction with reference to the crosswise center on the placement surface 51 and the bottom plane 61A to be close to or apart away from each other. The placement surface 51 and the bottom plane 61A are formed to have a first restricting portion 571 on the widthwise center thereof. The first restricting portion 571 is a protrusion extending along the conveying direction D1. On laterally outer sides of the guide rails 51G, 61G, second restricting portions 572, which are lateral walls of the hinges 50R, SOL, are formed to face each other.

As indicated by double-dotted dashed lines in FIG. 7, the guide pieces 57R, 57L may be placed in mutually closest positions, in which a crosswise distance between the guide pieces 57R, 57L is the smallest, whilst lateral edges of the first restricting portion 571 are contacted by the guide pieces 57R, 57L. In other words, the guide pieces 57R, 57L cannot be moved closer to each other beyond the first restricting portion 571. Therefore, when the guide pieces 57R, 57L are in the closest positions, the sheet 9, even smaller-sized sheets 9 such as a business card and a letter sheet, can be placed on a laterally correct position with reference to the widthwise center on the placement surface 51 and the bottom plane 61A as long as the smaller-sized sheet 9 fits in the smallest distance between the guide pieces 57R, 57L.

Meanwhile, as indicated in solid lines in FIG. 7, the guide pieces 57R, 57L may be placed in mutually farthest positions, in which the crosswise distance between the guide pieces 57R, 57L is the largest with outer side planes of the guide pieces 57R, 57L being in contact with the second restricting portions 572 respectively. Therefore, when the guide pieces 57R, 57L are in the farthest positions, the sheet 9, even a sheet 9 in a maximum allowable size (e.g., A4 size or legal size), can be placed on a laterally correct position with reference to the widthwise center on the placement surface 51 and the bottom plane 61A as long as the large-sized sheet 9 fits in the farthest distance between the guide pieces 57R, 57L.

As shown in FIGS. 1, 3, and 4, the discharge tray 6 can be stored in or drawn out of the chassis 8. When the discharge tray 6 is stored in the chassis 8 (see FIG. 1), the discharge tray 6 is exposed only at a front end of the discharge tray 6. When the discharge tray 6 is drawn out of the chassis 8 (see FIGS. 3 and 4), the discharge tray 6 can be placed in a posture to have a discharge surface 6A facing upward in a frontward position with respect to the chassis 8.

The image reading apparatus 1 further includes a power unit 3, a control board 5, and a reader unit 7 inside the chassis 8 (see FIGS. 4 and 5).

As shown in FIG. 4, the power unit 3 is disposed inside the chassis 8 on a side closer to the rear face of the chassis 8. The power unit 3 is an alternate current adaptor, which converts alternate current from an electricity outlet into direct current and supply the electricity to the reader unit 7. A rear side of the power unit 3 is covered by the rear cover 90. As shown in FIG. 3, on the rear cover 90, a connector hole 90E is formed. In the connector hole 90E, an end of an electricity cable 99 to electrically connect the power unit 3 with the electricity outlet is inserted.

As shown in FIG. 4, the control board 5 is arranged in a lower position with respect to the power unit 3 in the chassis 8. The control board 5 is electrically connected with the power unit 3 and the reader unit 7 by cables (not shown) to control behaviors of the reader unit 7.

As shown in FIGS. 4 and 5, the reader unit 7 includes a feed roller 71, a separator pad 79, a multiple sheet sensor 100, a conveyer roller 72, an image reading sensors 70A, 70B, and a discharge roller 73, which are arranged in the above-mentioned order along the conveyer path P1, from upstream to downstream, in the conveyer direction D1. The feed roller 71 picks up and feeds the sheet 9 in the conveying direction D1. The separator pad 79 nips the sheet 9 in cooperation with the feed roller 71 and separates the sheet 9 from the other sheets. The conveyer roller 72 conveys the separated sheet 9 forward in the conveying direction D1. The multiple sheet sensor 100 includes an emitter 101 and a receiver 102.

Positional relations amongst the feed roller 71, the separator pad 79, the emitter 101, the receiver 102, the conveyer roller 72, and the discharge roller 73 arranged in the conveyer path P1 along the conveying direction D1 are illustrated in FIG. 7. Further, in FIG. 7, positional relation between the feed roller 71 and the width-positioning guide 57 is illustrated.

As shown in FIGS. 5-7, the feed roller 71 is arranged in a downstream position with respect to the guide pieces 57R, 57L along the conveying direction D1. The feed roller 71 is attached to the lower chute 60 and is arranged on the lower guide 61 in the conveyer path P1. As shown in FIG. 7, a crosswise length L1 of the feed roller 71 is smaller than an amount of clearance G1 between the guide pieces 57R, 57L in the closest position. However, the crosswise length L1 of the feed roller 71 is substantially long to steadily convey even a smaller-sized sheet 9 being placed in the correct widthwise position. The feed roller 71 is driven to rotate by a driving unit (not shown) and feeds the sheet 9 in the conveying direction D1 by being rotated whilst the sheet 9 placed on the placement surface 51 is in contact with the feed roller 71.

As shown in FIGS. 3 and 5-7, the separator pad 79 is attached to the upper cover 93 and is arranged on the upper guide 94 in the conveyer path P1. The separator pad 79 is a thin piece of frictional material, such as rubber or elastomer. As shown in FIG. 7, a crosswise length L2 of the separator pad 79 is smaller than the crosswise length L1 of the feed roller 71. However, the crosswise length L2 of the separator pad 79 is substantially long to steadily separate the sheet 9 being fed by the feed roller 71. As shown in FIG. 5, the separator pad 79 is arranged in a position to face the feed roller 71 and urged against the feed roller 71 by a resilient member (not shown). Thereby, the separator pad 79 nips the sheet 9 in cooperation with the feed roller 71 and separates the sheet 9 from the other sheets, which may otherwise be fed in the conveyer path P1 along with the sheet 9.

As shown in FIGS. 5 and 7, the emitter 101 and the receiver 102 of the multiple sheet sensor 100 are arranged in a downstream position with respect to the feed roller 71 and the separator pad 79 along the conveying direction D1. As shown in FIGS. 5 and 8, the emitter 101 and the receiver 102 are arranged to vertically face each other across the conveyer path P1. In the cross sectional view shown in FIG. 8, taken along the line A-A (see FIG. 5), the feed roller 71 and the separator pad 79 are located on a farther side with respect to the upper guide 94 of the upper cover 93. Therefore, the feed roller 71 and the separator pad 79 interfered with by the upper guide 94 should not be seen in FIG. 8. However, in FIG. 8, a part of the upper guide 94 is indicated in an imaginary line to show the positions of the feed roller 71 and the separator pad 79.

As shown in FIG. 8, the emitter 101 is housed in a emitter housing hole 94B, which is formed to recess from the upper guide plane 94A of the upper guide 94 in upper-rightward inclination. As shown in FIGS. 7 and 8, the emitter 101 is disposed on a laterally outer side with respect to the feed roller 71 and the separator pad 79. More specifically, the emitter 101 is disposed in a rightward spaced-apart position with respect to a right-side end 71R of the separator roller 71 and a right-side end 79R of the separator pad 19.

Meanwhile, as shown in FIG. 8, the receiver 102 is housed in a sensor housing hole 62, which is formed to recess from the bottom plane 61A of the lower guide 61 in lower-leftward inclined orientation. The receiver 102 has a receiver surface 102A, which faces the emitter 101 and receives ultrasonic waves from the emitter 101. The receiver surface 102A is in a lower-leftward position with respect to the emitter 101 in a rightward-angled orientation.

As shown in FIGS. 7 and 8, the receiver 102 is disposed in the laterally outer side position with respect to the separator pad 79. More specifically, a left-side end of the receiver surface 102A is spaced apart for a length L3 to the right with respect to the right-side end 79R of the separator pad 79. Further, at least a part of the receiver 102 is located in a laterally inner position with respect to the feed roller 71. More specifically, a left-side end of the receiver surface 102A of the receiver 102 is spaced apart for a length L4 to the left with respect to the right-side end 71R of the feed roller 71.

For the receiver 102, except the receiver surface 102A, adhesive dust hardly affects quality to receive the ultrasonic waves emitted from the emitter 101 in the receiver 102. In other words, mainly the receiver surface 102A is affected by the dust in terms of the accuracy for receiving the ultrasonic waves. Therefore, the positional relation of the receiver 102 with the separator pad 79, the feed roller 71, and the conveyer roller 72 is defined based on the position of the receiver surface 102A.

As shown in FIGS. 7 and 8, an edge 62A of the sensor housing hole 62 facing the conveyer path P1 is in a laterally outer side position with respect to the separator pad 79. More specifically, a left-side end of the edge 62A is spaced apart for a length L5 to the right with respect to the left-side end 79R of the separator pad 79.

As shown in FIGS. 8 and 9, in the sensor housing hole 62, a support rib 62B, which protrudes leftward and extends vertically, is formed on an inner right-hand side. As shown in FIG. 8, the support rib 62B is formed in a shape of a triangular wedge, when viewed along the front-rear direction, and supports the receiver 102 in the sensor housing hole 62 by an oblique side thereof. As shown in FIG. 9, the support rib 62B divides a right-side area with respect to the receiver 102 in the sensor housing hole 62 into two sections along the front-rear direction. The area formed on the right-hand side of the receiver 102 and partitioned by the support rib 62B will be referred to as a recessed section 63, which is adjacent to the receiver 102 and recessed downward with respect to the edge 62A.

The multiple sheet sensor 100 is a known ultrasonic wave sensor, which emits ultrasonic waves from the emitter 101 and receives the emitted ultrasonic waves in the receiver 102 under control of the control board 5. If the sheet 9 is in the conveyer path P1 when the ultrasonic waves are emitted from the emitter 101, the ultrasonic waves transmit the sheet 9, and the waves to be received in the receiver 102 attenuate to a specific level. In this regard, attenuation rate for the ultrasonic waves depends on a quantity of sheets 9 being conveyed in the conveyer path P1. In other words, when two or more sheets 9 are conveyed in the conveyer path P1, the ultrasonic waves attenuate largely compared to attenuation of the ultrasonic waves transmitting a single sheet 9. The multiple sheet sensor 100 thus senses whether the sheet 9 being conveyed includes two or more sheets to detect the presence of multiple sheets based on the attenuation rate of the ultrasonic waves being received.

The guide pieces 57R, 57L in the closest position are indicated in double-dotted dashed lines in FIG. 8. In FIG. 8, further, a measurement point M1, in which the supersonic waves emitted from the emitter 101 toward the receiver 102 intersect the conveyer path P1, is indicated. The ultrasonic waves emitted from the emitter 101 transmit the sheet 9 being conveyed in the conveyer path P1 at the measurement point M1. The measurement point M1 is located in a crosswise position between the guide pieces 57R, 57L in the closest position (i.e., between auxiliary lines H1R, H1L, which are vertically extended from the guide pieces 57R, 57L).

As shown in FIGS. 5-7, the conveyer roller 72 is arranged in a downstream position with respect to the multiple sheet sensor 100 along the conveying direction D1. The conveyer roller 72 includes two conveyer rollers, which are arranged to align the crosswise direction. The conveyer roller 72 is attached to the lower chute 60 and is arranged on the lower guide 61 in the conveyer path P1. The conveyer roller 72 is driven by a driving unit (not shown) and rotates synchronously with the feed roller 71. As shown in FIG. 5, in an upper position with respect to the conveyer roller 72, a driven roller 72A is arranged to vertically face the conveyer roller 72. The driven roller 72A is attached to the upper cover 93 and is arranged on the upper guide 94 in the conveyer path P1. The driven roller 72A is urged against the conveyer roller 72 by a resilient member (not shown). Thereby, the conveyer roller 72 nips the sheet 9 in cooperation with the driven roller 72A and rotates to convey the sheet 9 toward the downstream in the conveyer path P1.

As shown in FIG. 7, the receiver 102 is disposed such that at least a part of the receiver 102 is located in a laterally inner position with respect to the conveyer roller 72. More specifically, a right-side end of the receiver surface 102A of the receiver 102 is spaced apart for a length L6 to the left with respect to the right-side end 72R of the conveyer roller 72.

As shown in FIG. 5, the image reading sensors 70A, 70B are arranged in downstream positions with respect to the conveyer roller 72 along the conveying direction D1. The image reading sensor 70A is attached to the lower chute 60 and is arranged on the lower guide 61 in the conveyer path P1. The image reading sensor 70B is attached to the upper cover 93 and is arranged on the upper guide 94 in the conveyer path P1. Thus, the image reading sensors 70A, 70B face each other vertically across the conveyer path P1. The image reading sensors 70A, 70B may be, for example, a contact image sensor (CIS) or a charge coupled device (CCD).

As shown in FIGS. 5-7, the discharge roller 73 is arranged in a downstream position with respect to the image reading sensors 70A, 70B along the conveying direction D1. The discharge roller 73 includes two discharge rollers, which are arranged to align the crosswise direction. The discharge roller 73 is attached to the lower chute 60 and is arranged on the lower guide 61 in the conveyer path P1. The discharge roller 73 is driven by a driving unit (not shown) and rotates synchronously with the feed roller 71 and the conveyer roller 72. As shown in FIG. 5, in an upper position with respect to the discharge roller 73, a driven roller 73A is arranged to vertically face the discharge roller 73. The driven roller 73A is attached to the upper cover 93 and is arranged on the upper guide 94 in the conveyer path P1. The driven roller 73A is urged against the discharge roller 73 by a resilient member (not shown). Thereby, the discharge roller 73 nips the sheet 9 in cooperation with the driven roller 73A and rotates to convey the sheet 9 to the discharge tray 6, which is in a downstream position with respect to the discharge roller 73 along the conveying direction D1.

Image Reading Operation

An image reading operation to read images appearing on the sheet 9 will be described below. When the operation starts, firstly, the feed roller 71 rotates under control of the control board 5 whilst the sheet 9 is nipped in between the feed roller 71 and the separator pad 79. Thus, the sheet 9 on the placement surface 51 is picked up and fed in the conveyer path P1 along the conveying direction D1. If multiple sheets are picked up in layer, solely one sheet 9 is separated from the others by the effect of friction force caused between the separator pad 79 and forwarded in the conveyer path P1.

Secondly, whilst the separated sheet 9 is conveyed in the conveyer path P1 in the conveying direction D1, the multiple sheet sensor 100 detects whether the sheet 9 has been separated from the other sheets by the separator pad 79. In other words, the multiple sheet sensor 100 detects the presence of multiple sheets, if any. If the multiple sheet sensor 100 detects the presence of multiple sheets, the control board 5 deals with the presence of multiple sheets by, for example, aborting the image reading operation and notifying the user of the presence of multiple sheets.

Thirdly, if presence of one sheet is detected, the conveyer roller 72 forwards the separated sheet 9 in the conveyer path P1, and the image reading sensors 70A, 70B read images appearing on the upper and lower sides of the sheet 9. The sheet 9 is thereafter conveyed to be discharged in the discharge tray 6 by the discharge roller 73.

Effects of the Present Disclosure

According to the image reading apparatus 1 described above, the receiver 102, as being one of the paired emitter 101 and receiver 102, is disposed in the laterally outer side position with respect to the separator pad 79 (see FIGS. 7 and 8). More specifically, the left-side end of the receiver surface 102A of the receiver 102 is spaced apart for the length L3 to the right with respect to the right-side end 79R of the separator pad 79. Therefore, although paper dust may be produced due to the friction between the separator pad 79 and the sheet 9, and the dust may flow toward the downstream in the conveying direction D1 along with the sheet 9, whilst the receiver surface 102A is spaced apart to the right with respect to the separator pad 79 and may not be in a direct path for the dust, the receiver surface 102A can be prevented from adherence of the dust.

Further, the receiver 102 is disposed in the position, in which at least a part of the receiver 102 is located in a laterally inner position with respect to the conveyer roller 72. More specifically, the right-side end of the receiver surface 102A of the receiver 102 is spaced apart for the length L6 to the left with respect to the right-side end 72R of the conveyer roller 72. In this arrangement, the sheet 9 can pass by the multiple sheet sensor 100 whilst the sheet 9 can be maintained tensioned between the feed roller 71, which is in an upstream position with respect to the multiple sheet sensor 100 in the conveying direction D1, and the conveyer roller 72, which is in a downstream position with respect to the multiple sheet sensor 100 in the conveying direction D1, over the multiple sheet sensor 100. Therefore, the presence of multiple sheets can be clearly detected by the multiple sheet sensor 100.

Thus, in the image reading apparatus 1 according to the present disclosure, accuracy of detecting the presence of multiple sheets can be prevented from being lowered.

Further, according to the image reading apparatus 1 described above, the receiver 102 is arranged on the lower guide 61, which is disposed in the lower position with respect to the conveyer path P1. Meanwhile, the paper dust produced by the friction between the separator pad 79 and the sheet 9 may tend to move toward the lower guide 61, which is in the lower position in the conveyer path P1. However, with the above-described arrangement, the receiver 102 is prevented from the dust adhering to the receiver surface 102A.

Further, in the image reading apparatus 1 described above, at least a part of the receiver 102 is located in the laterally inner position with respect to the feed roller 71. More specifically, the left-side end of the receiver surface 102A of the receiver 102 is spaced apart for the length L4 to the left with respect to the right-side end 71R of the feed roller 71. In this arrangement, whilst the sheet 9 being conveyed can be maintained tensioned over the multiple sheet sensor 100, which is in a downstream position with respect to the feed roller 71 in the conveying direction D1. Therefore, the presence of multiple sheets can be clearly detected by the multiple sheet sensor 100.

Further, in the image reading apparatus 1 described above, the sensor housing hole 62 is formed to recess downward from the lower guide plane 61A of the lower guide 61 in lower-leftward inclination. The edge 62A of the sensor housing hole 62 facing the conveyer path P1 is in the laterally outer side position with respect to the separator pad 79. More specifically, the left-side end of the edge 62A is spaced apart for the length L5 to the right with respect to the left-side end 79R of the separator pad 79. Thus, with the edge 62A being displaced to the right with respect to the separator pad 79, the receiver 102 may not be directly exposed to the flow of the dust and may be prevented from the dust adhering to the receiver surface 102A.

Further, in the image reading apparatus 1 described above, the sensor housing hole 62 is formed to have the recessed section 63 (see FIG. 9), which is adjacent to the receiver 102 and recessed downward with respect to the receiver 102. Therefore, the dust flowing in the sensor housing hole 62 may tend to accumulate in the recessed section 63 and may be prevented from adhering to the receiver 102.

Further, in the image reading apparatus 1 described above, the paired emitter 101 and the receiver 102 are arranged to face each other across the conveyer path P1. In this regard, the transmissive-typed sensor with the emitter 101 and the receiver 102 may be more accurately detect the presence of multiple sheets compared to a reflective-typed sensor. Thus, the accuracy of the multiple sheet sensor 100 may be relatively improved.

Further, in the image reading apparatus 1 described above, the emitter 101 is disposed in the laterally outer side position with respect to the receiver 102. In this arrangement, the receiver 102 can be placed in a closest position to the separator pad 79. Meanwhile, the emitter 101 can be disposed in the laterally outer side position to be spaced apart with respect to the separator pad 79 and the feed roller 71. Therefore, open space may be created in areas between the emitter 101 and the separator pad 79 and between the emitter 101 and the feed roller 71. Accordingly, the areas in the vicinities of the multiple sheet sensor 100 may be effectively utilized.

Further, in the image reading apparatus 1 described above, the measurement point M1 is located in the crosswise position between the guide pieces 57R, 57L being in the closest position (i.e., between auxiliary lines H1R, H1L, which are vertically extended from the guide pieces 57R, 57L). In this arrangement, the presence of multiple sheets 9 even in a maximum allowable sheet-width can be detected.

Although an example of carrying out the disclosure have been described, those skilled in the art will appreciate that there are numerous variations and permutations of the sheet conveyer that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

For example, the separator pad 79 may be replaced with a separator roller such as a retard roller.

For another example, the crosswise length between the left-side end of the receiver surface 102A and the right-side end 79R of the separator pad 79 may be zero. In other words, as shown in FIG. 10, the left-side end of the receiver surface 102A may be on an extended line H2, which extends from the right-side end 79R of the separator pad 79 in parallel with the conveying direction D1.

For another example, a left-side part of the receiver 102 may be disposed in a laterally inner side with respect to the conveyer roller 72. More specifically, as shown in FIG. 11, the right-side end of the receiver 102A may be spaced apart to the right for a length L7 with respect to the right-side end 72R of the conveyer roller 72, and the left-side end of the receiver surface 102A may be spaced apart to the left for a length L8 with respect to the right-side end 72R of the conveyer roller 72.

For another example, the positions of the feed roller 71, which is on the lower side with respect to the conveyer path P1, and the separator pad 79, which is on the upper side with respect to the conveyer path P1 to face the feed roller 71 from above, may be replaced with each other.

For another example, the positions of the receiver 102 and the emitter 101 may be replaced with each other. That is, the emitter 101 may be disposed in the sensor housing hole 62, and the receiver 102 may be disposed in the housing hole 94B, which is formed to recess from the upper guide plane 94A of the upper guide 94.

For another example, whilst the measurement point M1 may be located in the position laterally between the guide pieces 57R, 57L being in the closest position, the emitter may not necessarily be disposed in the rightward position with respect to the guide piece 57R. For example, the emitter 101 and the receiver 102 may be disposed in positions laterally between the guide pieces 57R, 57L being in the closest position. In this arrangement, the measurement point M1 should easily fall in the position laterally between the guide pieces 57R, 57L being in the closest position.

For another example, the multiple sheet sensor 100 may not necessarily be a transmissive-typed ultrasonic wave sensor, with the emitter 101 and the receiver 102 being arranged to face each other across the conveyer path P1. For example, the multiple sheet sensor may be a reflective-typed ultrasonic wave sensor, in which ultrasonic waves emitted from a emitter are reflected on the sheet in the conveyer path P1 and the reflected ultrasonic waves are received in the receiver. Further, the multiple sheet sensor may be an optical sensor, in which light is emitted from an emitter, and the light transmitting through the sheet or reflected on the sheet is received in a receiver.

The sheet conveyer described above may be applied to, for example, an image reading apparatus, an image forming apparatus or a multifunction device.

What is claimed is:

1. A sheet conveyer configured to convey a sheet in a conveyer path, comprising:

a first roller configured to contact the sheet and rotate to convey the sheet in a conveying direction;

a separator arranged to be opposed to the first roller and configured to nip the sheet in cooperation with the first roller and to separate the sheet from other sheets;

a multiple sheet sensor arranged in a downstream position in the conveying direction with respect to the first roller and configured to sense presence of multiple sheets, the multiple sheet sensor including a receiver and a paired emitter paired with the receiver, the receiver being configured to receive an object emitted from the paired emitter; and a second roller arranged in a downstream position in the conveying direction with respect to the multiple sheet sensor and configured to convey the separated sheet, one of the receiver and the paired emitter being arranged at least partially in an outer side position with respect to the separator along a widthwise direction, which is orthogonal to the conveying direction, the one of the receiver and the paired emitter being arranged at least partially in an inner side position with respect to the second roller along the widthwise direction, and the other one of the receiver and the paired emitter being arranged at least partially in an outer side position with respect to the separator along the widthwise direction.

2. The sheet conveyer according to claim 1, wherein the conveyer path is formed between an upper guide and a lower guide, wherein the lower guide is disposed lower than the upper guide, and wherein the one of the receiver and the paired emitter is arranged on the lower guide.

3. The sheet conveyer according to claim 1, wherein at least a part of the one of the receiver and the paired emitter is arranged in an inner side position with respect to the first roller along the widthwise direction.

4. The sheet conveyer according to claim 1, wherein the one of the receiver and the paired emitter is housed in a sensor housing hole, which is formed to recess downwardly from the conveyer path in an inclined orientation with respect to the widthwise direction, an edge of the sensor housing hole being at least partially in an outer side position with respect to the separator along the widthwise direction.

5. The sheet conveyer according to claim 4, wherein the sensor housing hole is configured to form a recessed section, which is adjacent to the one of the receiver and the paired emitter and recesses downwardly.

6. The sheet conveyer according to claim 1, wherein the receiver and the paired emitter in the multiple sheet sensor are arranged to be opposed to each other across the conveyer path.

7. The sheet conveyer according to claim 1, further comprising:

a width-position guide configured to restrict a position of the sheet in the widthwise direction, the width-position guide including a pair of guide members, which are arranged to be opposed to each other along the widthwise direction, the guide members being configured to be placed in a closest position, in which a distance between the guide members is smallest, and to be placed in a farthest position, in which the distance between the guide members is largest, the guide members being movable between the closest position and the farthest position, and a measurement point, in which waves emitted from the paired emitter toward the receiver intersect the conveyer path, being set in a position between the guide members placed in the closest position.

8. The sheet conveyer according to claim 1, further comprising:

a controller configured to determine whether multiple sheets have been fed or not.

* * * * *